US008081908B2

(12) United States Patent
Sukeno et al.

(10) Patent No.: US 8,081,908 B2
(45) **Date of Patent: *Dec. 20, 2011**

(54) TONER BOTTLE FOR ELECTROSTATIC LATENT IMAGE DEVELOPING

(75) Inventors: Mikihiko Sukeno, Tokyo (JP); Yoshiaki Kobayashi, Tokyo (JP); Michiaki Ishikawa, Kanagawa (JP); Tsuyoshi Uchida, Tokyo (JP); Masaharu Shiraishi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 623 days.

This patent is subject to a terminal disclaimer.

(21) Appl. No.: 12/127,494

(22) Filed: May 27, 2008

(65) Prior Publication Data

US 2008/0304869 A1 Dec. 11, 2008

(30) Foreign Application Priority Data

Jun. 5, 2007 (JP) ..... 2007-149040

(51) Int. Cl.
*G03G 15/08* (2006.01)

(52) U.S. Cl. ..... 399/259

(58) Field of Classification Search ..... 399/262, 399/259, 120

See application file for complete search history.

(56) References Cited

U.S. PATENT DOCUMENTS 4,623,605 A * 11/1986 Kato et al. ..... 430/108.6
6,022,661 A * 2/2000 Kurose et al. ..... 430/108.7
6,067,432 A * 5/2000 Huang ..... 399/262
6,197,466 B1 * 3/2001 Fields et al. ..... 430/111.33
6,200,722 B1 * 3/2001 Fields et al. ..... 430/137.21
2004/0126692 A1 * 7/2004 Yamanouchi et al. ..... 430/110.3
2005/0042532 A1 * 2/2005 Iida et al. ..... 430/45
2006/0182469 A1 * 8/2006 Koyama et al. ..... 399/258
2007/0092302 A1 * 4/2007 Koyama ..... 399/258
2007/0217826 A1 * 9/2007 Koyama ..... 399/258
2008/0261138 A1 * 10/2008 Sukeno et al. ..... 430/108.6

FOREIGN PATENT DOCUMENTS

JP 07-049585 2/1995

(Continued)

OTHER PUBLICATIONS

Machine translation of reference Yasuno et al. (JP 2006-250,990) Pub date Sep. 21, 2006.*

(Continued)

*Primary Examiner* — David Gray
*Assistant Examiner* — Rodney Bonnette
(74) *Attorney, Agent, or Firm* — Lucas & Mercanti, LLP

(57) ABSTRACT

A toner bottle containing a cylindrical toner container having therein a toner comprising at least a resin, a colorant and an external additive, the toner container having a toner discharge port on an end thereof and a rotation axis along the cylindrical toner container, and the toner container being installable in an image forming apparatus, wherein the toner container has plural protrusions which are intermittently provided in an interior of the cylindrical container, the protrusions having a function to convey the toner toward the toner discharge port when the toner container is rotated around the rotation axis; an X-ray intensity ratio of titanium to silicon (Ti/Si) determined via X-ray fluorescence spectrometry of the toner is 1.0 to 3.0; and a conveyance index of the toner is 2.0 to 10.0 mg/sec.

13 Claims, 6 Drawing Sheets

FOREIGN PATENT DOCUMENTS

| | | |
|---|---|---|
| JP | 2002-182424 | 6/2002 |
| JP | 2005234083 | 9/2005 |
| JP | 2005300911 | 10/2005 |
| JP | 2006163365 | 6/2006 |
| JP | 2006-215151 | 8/2006 |
| JP | 2006250990 | 9/2006 |
| JP | 2008-203367 | 9/2008 |

OTHER PUBLICATIONS

Japanese Office Action date mailed Sep. 27, 2011 (3 pages).

English language translation of Japanese Office Action date mailed Sep. 27, 2011 (6 pages).

* cited by examiner

TONER BOTTLE FOR ELECTROSTATIC LATENT IMAGE DEVELOPING

TECHNICAL FIELD

The present invention relates to a toner bottle for electrostatic latent image developing.

BACKGROUND

Currently, most electrostatic latent images are developed using dry toners in image forming apparatuses such as copiers, printers, and facsimile machines employing a method of developing electrostatic latent images. In these cases, image forming apparatuses are equipped with a toner container such as a toner bottle or a toner cartridge containing a dry toner which is fed to the developing device from the toner container.

Accordingly, there has been in demand a toner container which can assuredly prevent toner leakage during storage or transportation; can be easily attached to and removed from an image forming apparatus; can prevent toner leakage during toner container exchange; is not costly; and further is desirably recoverable and recyclable. Therefore, much research effort has been directed toward the development of such a toner container (refer to Patent Documents 1 and 2).

In contrast, specifically via digital image formation, toner images exhibiting excellent thin-line reproduction and high resolution have been demanded. As toners satisfying these requirements, chemical toners represented by polymerized toners may be exemplified, from which it is expected to be able to develop ultra-low temperature fixing toners employing polymerized toner techniques (refer to Patent Documents 3 and 4).

Further, when a low temperature fixing toner is stored in a state where the toner is placed in an image forming apparatus for an extended duration, there have been noted problems such as adhesion of toner particles among themselves or adhesion between the toner and the toner container depending on the environment conditions, resulting in an unreliable toner supply from the toner container outlet.

Patent Document 1: Japanese Patent Application Publication Open to Public Inspection (hereinafter, referred to as JP-A) No. 2006-163365

Patent Document 2: JP-A No. 2005-300911

Patent Document 3: JP-A No. 2006-250990

Patent Document 4: JP-A No. 2005-234083

SUMMARY OF THE INVENTION

An object of the present invention is to provide a toner bottle containing a toner exhibiting excellent fluidity, excellent blocking resistance, excellent storage stability while providing a high resolution image and ultra-low temperature fixability, the toner bottle exhibiting an anti-granulation property of the toner particles and enabling a smooth toner supply to the image forming apparatus.

One of the aspects of the present invention to achieve the above object is a toner bottle containing a cylindrical toner container having therein a toner comprising at least a resin, a colorant and an external additive, the toner container having a toner discharge port on an end thereof and a rotation axis along the cylindrical toner container, and the toner container being installable in an image forming apparatus, wherein the toner container has plural protrusions which are intermittently provided in an interior of the cylindrical container, the protrusions having a function to convey the toner toward the toner discharge port when the toner container is rotated around the rotation axis; an X-ray intensity ratio of titanium to silicon (Ti/Si) determined via X-ray fluorescence spectrometry of the toner is 1.0 to 3.0; and a conveyance index of the toner is 2.0 to 10.0 mg/sec.

DESCRIPTION OF THE PREFERRED EMBODIMENTS

Figure 1:
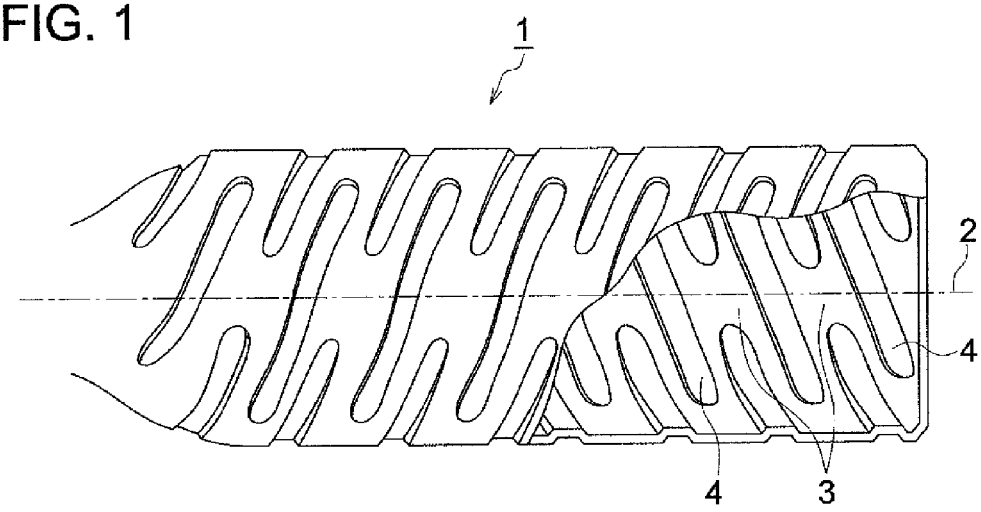
FIG. 1 illustrates an external view of one example of a toner container having transporting protrusions.

In the present invention, it was found that the problems could be overcome by using a toner bottle obtained by appropriately selecting an external additive for the toner in addition to keeping the quality of the toner and by appropriately selecting the shape of the toner container to be used with the toner.

The present invention can provide a toner bottle containing a toner exhibiting excellent fluidity, excellent blocking resistance, excellent storage stability while providing a high resolution image and ultra-low temperature fixability, the toner bottle exhibiting an anti-granulation property of the toner particles and enabling a smooth toner supply to the image forming apparatus.

Over recent years, a tendency of image quality enhancement has been greatly noted. To respond to this situation, utilized has been the toner having not only a small particle diameter together with a small particle diameter distribution width, but also having uniform particle shape.

The present invention has been carried out to overcome problems which were inherent in developing a toner featuring a small particle diameter required for enhanced image quality, and further exhibiting low temperature fixability and excellent blocking resistance during storage, as well as exhibiting excellent chargeability.

Namely, to produce a toner, having been recently in demand, which produces a high quality image and exhibits low temperature fixability, and further exhibits excellent chargeability and blocking resistance, it is necessary for the toner to feature a small particle diameter, a narrow range of toner particle distribution, and a uniform toner shape, and further to exhibit a low glass transition temperature (Tg) and very high fluidity. However, in image formation via such a toner fed to an actual developing device, it was found that it is desirable to pay attention to the shape of the toner container, in addition to the toner itself in order not to cause a problem.

This tendency is noticeable in a toner exhibiting a low glass transition temperature and enhanced fluidity, as employed in the present invention.

Namely, in the present invention, it has become possible, for the first time, to use an ultra-low temperature fixing toner without any problem by charging the toner having the constitution described in the present invention in the toner container of the present invention.

Subsequently, the toner used in the present invention, compounds used for the toner, and the mechanism of the toner container will be further described.

[Toner of the Present Invention]

The glass transition temperature (Tg) of the toner of the present invention is from 16-60° C., which is low in the currently used toners. The reason is that those having a glass transition temperature (Tg) of less than 16° C. tend to produce problems such as blocking during storage even when it is applied to the constitution of the present invention, while those of more than 60° C. tend to cause problems in low temperature fixability.

The glass transition temperature (Tg) of the toner of the present invention was determined according to the method described below.

(Determination of Glass transition temperature (Tg))

The glass transition temperature (Tg) can be determined using differential scanning calorimeter "DSC-7" (produced by Perkin Elmer, Inc.) and thermal analyzer controller "TAC 7/DX" (produced by Perkin Elmer, Inc.).

Operational procedures are as follows: 4.5-5.0 mg of a sample to be determined is collected, precisely weighed to two of decimal places, sealed in an aluminum pan (Kit No. 0219-0041), and placed in "DSC-7 sample holder"; an empty aluminum pan is used as the reference; determination is carried out under conditions of a measurement temperature range of 0-200° C., a temperature increasing rate of 10° C./minute, and a temperature decreasing rate of 10° C./minute via a heating-cooling-heating temperature control; and analysis is conducted based on data at the 2nd heating.

The glass transition temperature is obtained as one which is read at the intersection of the extension of the base line, prior to the initial rise of the first endothermic peak, with the tangent showing the maximum inclination between the initial rise of the first peak and the peak summit.

Production methods of the toner of the present invention are not specifically limited. Any appropriate binder resins and colorants known in the art can optionally be used for the toner.

Suitable shape distribution of toner particles for use in the present invention is preferably one having such a long axis/short axis ratio as described below A toner with such a feature exhibits enhanced cleaning and transfer properties, resulting in excellent halftone images and stably high image quality.

(Preferable Toner Particle Shape)

The particle shape of the toner preferably used in the present invention is defined in a manner described below.

Figure 7:
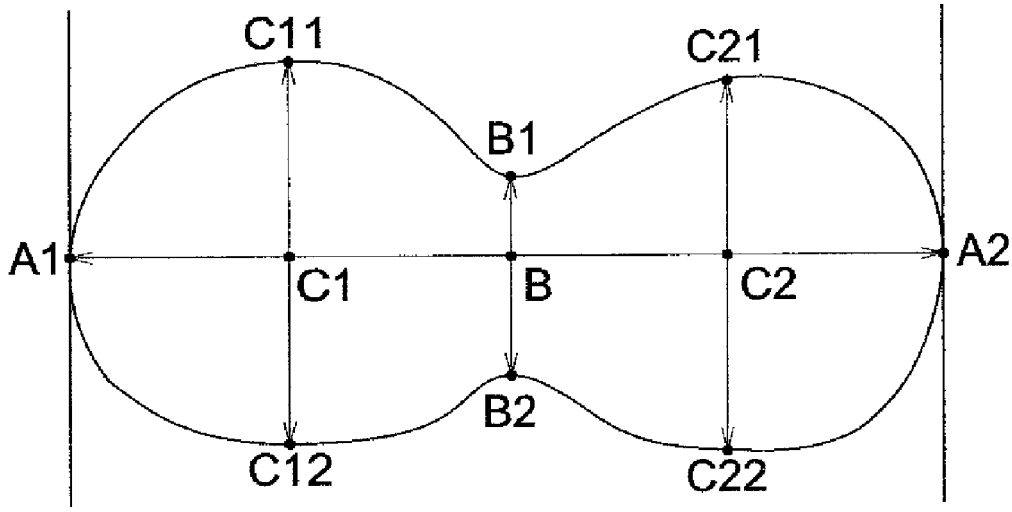
FIG. 7 illustrates an explanatory view of a particle shape of the toner of the present invention.

In FIG. 7, 1) a closed curve, which is a contour of the projected plane of at least one of the toner particles, is sandwiched by two parallel lines contacting the closed curve at points A1 and A2, and the line segment (A1, A2) having the maximum length is designated as the long axis of the toner particle, 2) when the middle point of the line segment (A1, A2) is designated as B, and the intersections of the perpendicular bisector of the line segment (A1, A2), passing the above point B, with the closed curve, being the toner particle contour, are each designated as B1 and B2, the line segment (B1, B2) is designated as a first short axis of the toner particle; 3) when the middle point of the line segment (A1, B) is designated as C1, the intersections of the perpendicular bisector of the line segment (A1, B), passing C1, with the closed curve, being the contour of the toner particle, are each designated as C11 and C12; 4) when the middle point of the line segment (A2, B) is designated as C2, the intersections of the perpendicular bisector of the line segment (A2, B), passing C2, with the closed curve, being the contour of the toner particle, are each designated as C21 and C22; and 5) when the line segment (C11, C12) or the line segment (C21, C22), whichever is longer, is designated as a second short axis of the toner particle, 6) the toner incorporates 5-50% by number of toner particles featuring a length ratio of the second short axis to the first short axis of 1.1-1.6.

Actual measurement of the shape of the toner particle is carried out as follows: at least 500 toner particles are randomly selected in a toner particle photograph taken at a magnification of 5000 using a scanning electron microscope (SEM), and then the shapes thereof are evaluated whether or not the above conditions are satisfied.

[External Additives]

As external additives, silica, titanium oxide, and composite metal oxides are usable.

More specifically, employable silica includes silica, available on the market, produced via dry production methods such as AEROSIL 50, AEROSIL 90G, AEROSIL 130, AEROSIL 200, AEROSIL 300, AEROSIL 380, AEROSIL TT600, AEROSIL MOX170, AEROSIL MOX80, and AEROSIL COK84 (all produced by Nippon Aerosil Co., Ltd.); Ca—O—SiL L-90, Ca—O—SiL LM-130, Ca—O—SiL LM-150, Ca—O—SiL M-S, Ca—O—SiL PTG, Ca—O—SiL MS-55, Ca—O—SiL H-5, Ca—O—SiL HS-5, and Ca—O—SiL EH-5 (all produced by Cabot Corp.); WACKER HDK, WACKER N20, WACKER U15, WACKER N20E, WACKER T30, and WACKER T40 (all produced by Wacker-Chemie GmbH), D-C Fine Silica (produced by Dow Corning Corp.); Fransol (produced by Fransil Co.); and ADMAFINE SO-E2, ADMAFINE SO-E3, ADMAFINE SO-C2, ADMAFINE SO-C3, and ADMAFINE SO-C5 (all produced by Admatechs Co., Ltd.), as well as including silica, available on the market, produced via wet production methods such as Carplex #67, Carplex #80, Carplex #100, Carplex #1120, FPS-1, FPS-3, and FPS-4 (all produced by Shionogi & Co., Ltd.) and SEAHOSTAR (produced by Nippon Shokubai Co., Ltd.). Further, inorganic particles having a primary particle diameter of at least 0.1 μm produced via a sol-gel method may preferably be used.

Employable titanium oxide includes anatase-type titanium dioxide, available on the market, such as KA-10, KA-15, KA-20, KA-30, KA-35, KA-80, KA-90, and STT-30 (all produced by Titan Kogyo Co., Ltd.); rutile-type titanium dioxide, available on the market, such as KR-310, KR-380, KR-460, KR-480, KR-270, and KV-300 (all produced by Titan Kogyo Co., Ltd.); titanium dioxide, available on the market, such as MT-150A, MT-600B, MT-100S, MT-500B, JR-602S, and JR-600A (produced by Teika Co., Ltd.); and titanium dioxide, available on the market, such as P25 (produced by Nippon Aerosil Co., Ltd.).

Inorganic particles are commonly employable as external additives functioning to aid fluidity, developability, or chargeability of toner particles. Of these, silica particles and titanium oxide particles are simultaneously used in the present invention. The number average primary particle diameter of these particles are preferably from 5 nm-2000 nm, but specifically, preferably from 5 nm-200 nm. Further, the specific surface areas thereof based on a BET method are preferably from 20-500 $m^2/g$.

The ratio of the silica particles and the titanium oxide particles used is preferably from 0.01-5% by mass, but specifically, preferably 0.01-2.0% by mass based on the toner mass.

Herein, a primary particle diameter may be determined using a TEM (transmission electron microscope) or a FE-SEM (field emission-type scanning electron microscope). Further, in cases in which particles are needle-like or polyhedral particles, the longer diameter of the particles is designated as the primary particle diameter.

Surface treatment of these fluidizers makes it possible to enhance hydrophobic properties and then to minimize degradation of fluidity or chargeability even under high-humidity conditions. Examples of preferable surface treatment agents include silane coupling agents, silylation agents, silane coupling agents having fluorinated alkyl groups, organic titanate-based coupling agents, aluminum-based coupling agents, silicone oil, and modified silicone oil.

Composite Metal Oxide Particles

In composite metal oxide particles of the present invention used as an external additive, each particle incorporates two or more metal oxides such as amorphous silica and titanium oxide to form one particle.

As the above composite metal oxide particles, preferable are particles in each of which amorphous silica and crystallized metal oxide coexist to form a sea-island structure within a region of at most 100 nm. Alternatively, in the composite metal oxide particles, amorphous silica may form a core having crystallized metal oxide on the surface of the core, and further crystallized metal oxide may form a core having amorphous silica on the surface of the core.

The abundance ratio of silica in a composite metal oxide of silica and titanium oxide according to the present invention is 1.0-99% by mass, more preferably 2.5-85% by mass, provided that silica is detected via Electron Spectroscopy for Chemical Analysis (ESCA).

As an example, a composite metal oxide, characterized in that amorphous silica is in a core and a crystallized metal oxide is present on the surface of the core, will now be detailed.

The composite metal oxide used in the present invention is preferably one which incorporates amorphous silica and a metal oxide as described above, wherein the metal oxide is present on the surface of the amorphous silica and the metal oxide is crystallized at the surface of the composite metal oxide.

The number average primary particle diameter of the composite metal oxide is preferably 35-500 nm, more preferably 40-300 nm, from the viewpoint of stabilizing the charge of the toner surface and of allowing the external additive itself to be stably held on the surface of the toner parent body.

The number average primary particle diameter may be determined using a high-resolution transmission electron microscope (HR-TEM). Specifically, the FERE horizontal diameters of 100 particles of composite metal oxide are measured and the arithmetic average thereof is calculated. The particle selection is carried out via selection of the composite metal oxide adhering to the contoured portion of the toner particles.

The composite metal oxide particles of the present invention are preferably treated with a hydrophobizing agent known in the art such as a silane coupling agent or silicone oil, but a preferable hydrophobizing agent is a hexamethyldisilane compound.

[X-ray Intensity Ratio (Ti/Si) of Titanium to Silicon]

The X-ray intensity ratio of titanium to silicon, determined via X-ray fluorescence spectrometry of the toner of the present invention, is 1.0-3.0. The determination of the X-ray intensity ratio of titanium and silicon was carried out as follows.

(Measurement Method via X-ray Fluorescence Spectrometry (WDX))

The amounts of Ti and Si elements in the toner can be determined using X-ray fluorescence spectrometer "XRF-1700" (produced by Shimadzu Corp.). In a specific measurement method, measurement was carried out on a pressed pellet of 2 g of a toner specimen under conditions described below. Herein, in the measurement, the Kα peak angle of an element to be measured, which was determined using the 2θ table, was employed.

X-ray generator conditions: target Rh; tube voltage 40 kV; tube current 95 mA; and no filter Spectrometer conditions: standard slit; no attenuator; dispersive crystal (Ti=LiF, Si=PET); and detector (Ti=SC, Si=FPC)

The ratio of Ti to Si was calculated as a value, wherein the net intensity of Ti Kα peak was divided by the net intensity of Si Kα peak.

When the ratio of Ti to Si in the toner is larger than 3.0, toner particles may be damaged when supplied to the main body of an image forming apparatus to form partial granulation of the particles, resulting in forming an unacceptable image defect such as thin spots in the image. When the ratio of Ti to Si in the toner is smaller than 1.0, fog tends to be formed at a high toner consumption mode or uniformity of a half-tone image tends to be lost.

(Conveyance Index)

The conveyance index of the toner can be measured, for example, according to the method disclosed in U.S. Pat. No. 7,018,761. The "conveyance index" described herein refers to an index of conveyance property of the toner particle typically obtained by measurement using the parts feeder shown in FIG. 8 under constant vibration, and expresses how readily the toner can be conveyed, or in other words, mobility of the toner.

It is to be noted that the conveyance index described herein is different from generally known fluidity evaluated, for example, by static bulk density or angle of repose, measured under rest status of the toner.

Figure 8:
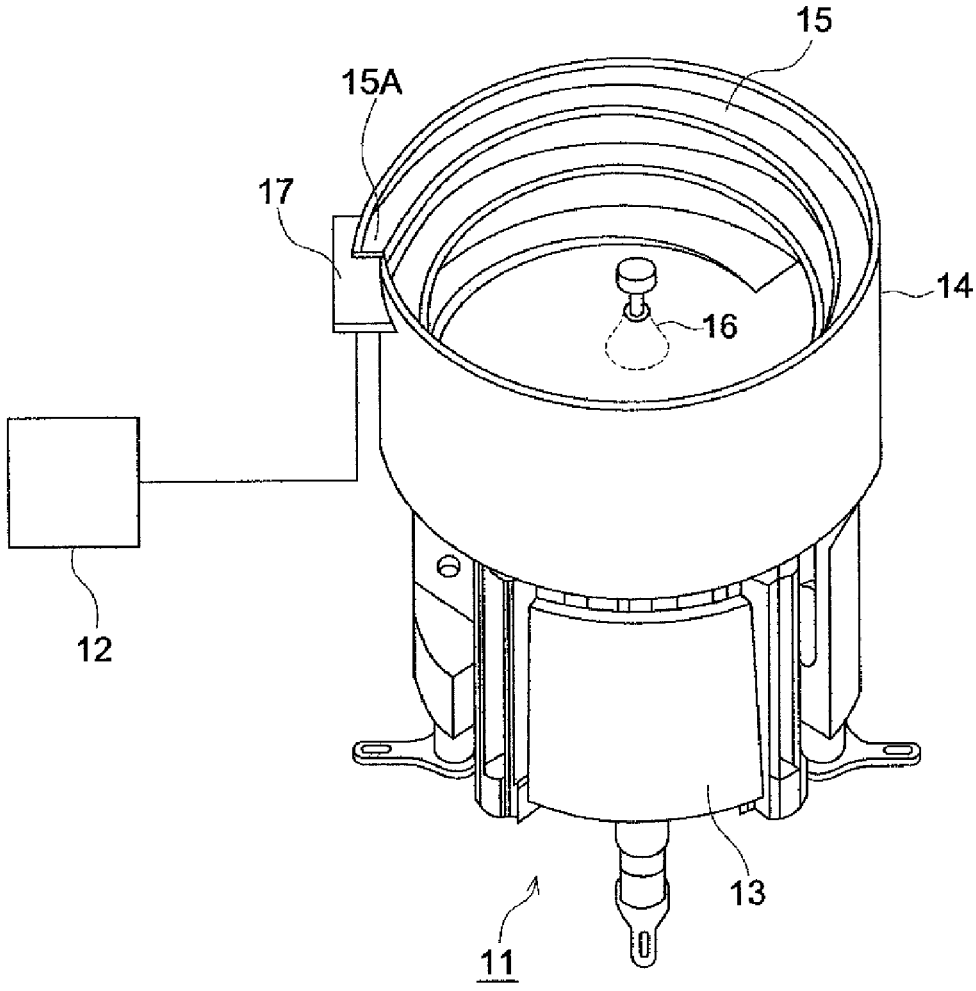
FIG. 8 illustrates an explanatory schematic drawing showing one exemplary configuration of a parts feeder for measuring conveyance index of the toner.

More specifically, as shown in FIG. 8, the parts feeder 11 comprises a driving source 13 for generating a specific vibration, and a cylindrical bowl 14 supported above the driving source 13. The bowl 14 has a spiral slope way 15 formed on the inner circumferential wall thereof so as to connect the bottom plane to the upper end rim. The slope way 15 is disposed so that the upper end portion 15A thereof is projected out from the side wall of the bowl 14 outwardly in a radial direction at the same level of height as the upper end rim of the bowl. In FIG. 8, reference numeral 16 represents the center axis of the bowl 14, reference numeral 17 represents a pan disposed below the upper end portion 15A of the slope way 15, and reference numeral 12 represents a weighing means connected to the pan 17.

In this parts feeder 11, rotation power is supplied from the driving source 13 to the bowl 14 and is converted into vibratory motion for making the bowl 14 vibrate as a whole. By changing the limiting positions of the vertical motion with the action of springs disposed at angles, the toner placed in the bowl 14 is transferred upward along the slope way 15 and drop from the upper end portion 15A of the slope way 15 into the pan 17.

In the present invention, the conveyance index of the toner is determined using parts feeder ME-14 (manufactured by SHINKO ELECTRIC CO., LTD.) by operating at a frequency of 120 rps (revolutions per second) and at a voltage of 80 V, according to the following procedure: 1 g of the toner is put around the center axis 16 in the bowl 14; the driving source 13 is allowed to operate at a frequency of 120 rps and a voltage of 80 V, so as to transfer the toner upward along the slop way 15 to make it reach the pan 17. The amount of toner reached the pan 17 is weighed by the weighing means 12. The durations of time between the start of operation of the driving source 13 and the points of time when the amount of the toner reached the pan 17 is 300 mg and 750 mg, respectively, are measured, and the conveyance index is calculated by Equation (1):

$$\text{Conveyance index}=(750-300)\ \text{mg}/(T750-T300)\ \text{sec} \quad \text{In Equation (1)}$$

In Equation (1), T300 is a time required for transferring 300 mg of the toner to the pan 17, and T750 is a time required for transferring 750 mg of the toner to the pan 17.

The details of the bowl 14 of parts feeder: ME-14 will be shown below:

| | |
|---|---|
| Outer diameter of the spiral | about 160 mm |
| Inner diameter of the spiral | about 90 mm |
| Track length | 1430 mm |
| Height difference of within track | 40 mm |
| Width of the track | 9 mm |
| Material of the bowl | Aluminum |

The conveyance index of the toner of the present invention is 2.0 to 10.0, preferably 2.0 to 9.0, and more preferably 2.0 to 3.0.

In the present invention, the method to control the conveyance index of the toner is not specifically limited. The conveyance index may be controlled, for example, by adding silica and titanium oxide as external additives to toner particles having the shape described in above "(Preferable Toner Particle Shape)" (refer to FIG. 7). Dry method silica having primary particle diameters of 5-20 nm produced by a vapor phase oxidation of a silicon halide can be preferably used as the above silica, and further preferable is silica particles of which surfaces are subjected to hydrophobic treatment. Anatase or rutile titanium oxide particles having primary diameters of 20-100 nm can be preferably employed as the above titanium oxide. Further, in order to control the conveyance index of a toner in the prescribed range of the present invention, it is preferable to add the above described composite metal oxide as an external additive.

When the conveyance index is more than 10.0, the toner tends to be transferred to the developing zone of an image forming apparatus only in a short time due to its excessively large fluidity. That is, because the amount of incorporation of the developer tends to be large in the development limiting portion, the toner cannot fully be charged and a weakly charged toner exists. This raises a problem of causing dusting or fogging during the image transfer, and prevents formation of sharp images.

On the other hand, if the conveyance index is less than 2.0, the toner can surely be charged since duration of time before the toner is transferred to the developing zone is sufficiently long. However, tracking failure may occur due to its poor transferability, and this may cause non-uniform image density. This is also causative of adhesion in the toner layer limiting member or the like in continuous copying, and results in white stream noise on a black background. A problem of reduction in the image density may also arise.

[Toner Container]

The toner container usable in the present invention is a cylindrical container installable in an image forming apparatus. The toner container has a toner discharge port on an end of the cylindrical container and a rotation axis along the cylindrical toner container. The toner container has plural protrusions which are intermittently provided in an interior of the cylindrical container. The protrusions each have a longitudinal direction and the longitudinal direction has an inclination against a direction of the rotation axis. The protrusions have a function to convey the toner toward the toner discharge port when the toner container is rotated around the rotation axis. The toner container of the present invention is not specifically limited as far as the above conditions are satisfied.

Examples and comparative examples of the shape of the toner container are shown in FIGS. 1-5. The shape of the interior wall of the toner container is usually invisible. However, since this portion is of essential importance in the present invention, each of the toner containers is shown in FIGS. 1-5 in such a manner that part of the exterior wall thereof is removed.

Figure 2:
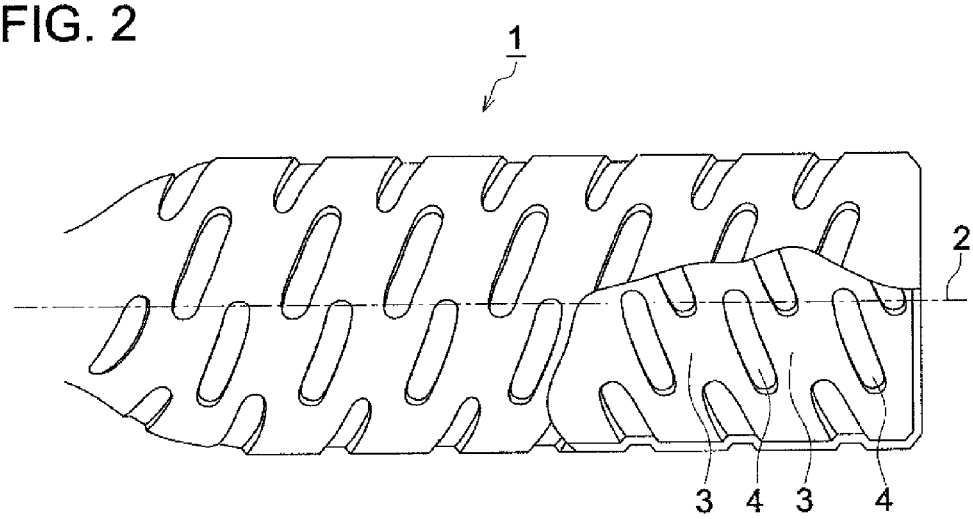
FIG. 2 illustrates an external view of another example of a toner container having transporting protrusions.
Figure 3:
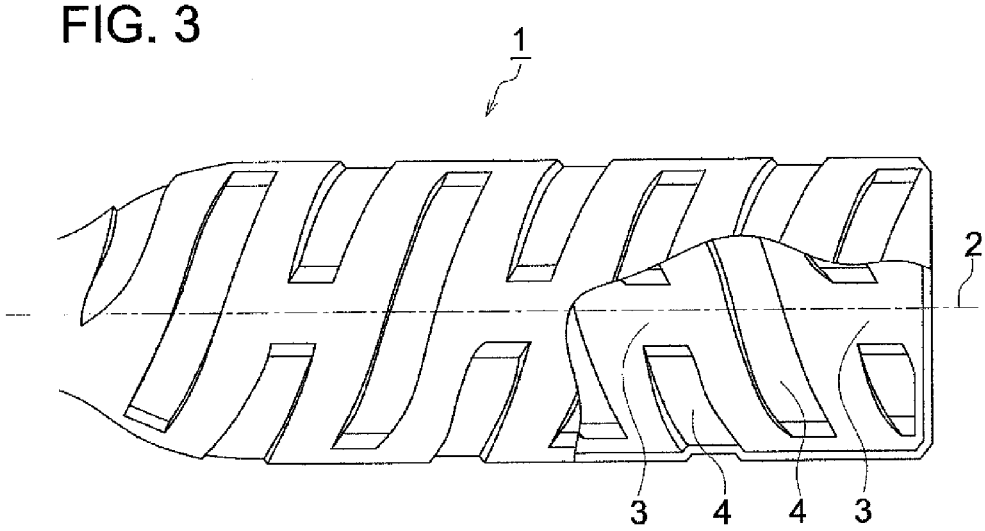
FIG. 3 illustrates an external view of another example of a toner container having transporting protrusions.
Figure 4:
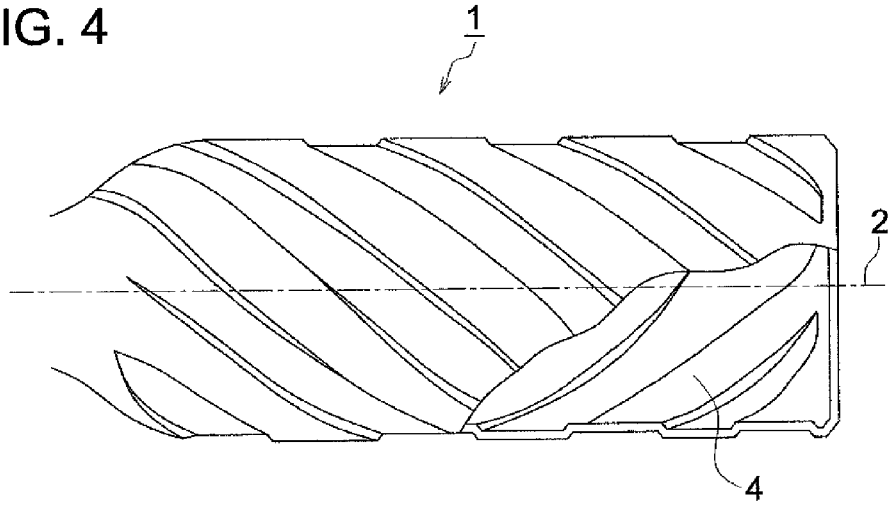
FIG. 4 illustrates an external view of another example of a toner container having comparative transporting protrusions.
Figure 5:
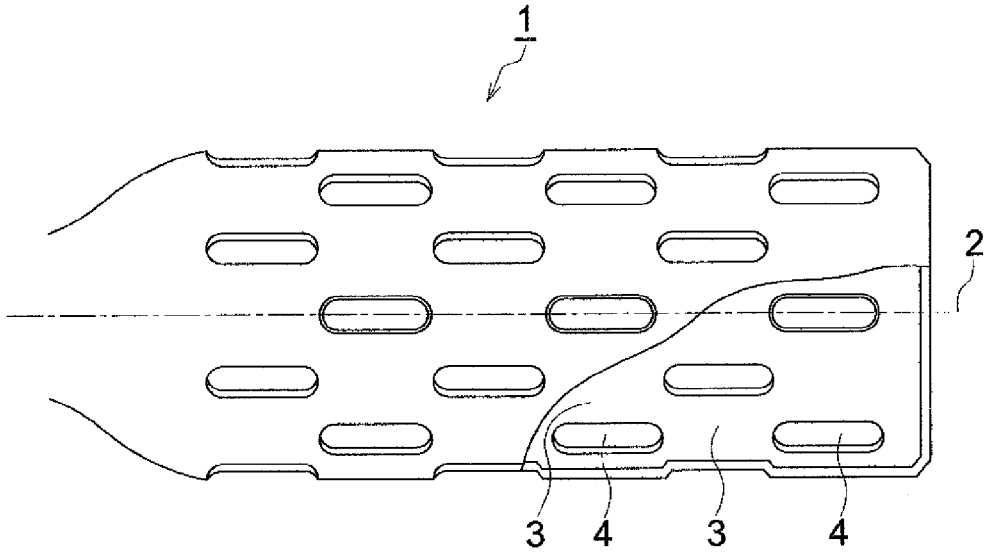
FIG. 5 illustrates an external view of another example of a toner container having comparative transporting protrusions.

Symbol 1 represents each of the toner containers shown in FIGS. 1-5. Although not shown, a toner discharge port is arranged on the left side portion of the toner container and a toner is fed into the main body of an image forming apparatus. Further, those shown in FIGS. 4 and 5 are comparative examples which will be described later.

The toner container is actually placed in an image forming apparatus and the toner container 1 rotates around a rotating axis 2 serving as the central axis during feed of the toner (no rotation-driving method is shown), whereby the toner contained in the toner container is fed into the image forming apparatus.

To transport the toner in the direction of the toner discharge port via rotation of the toner container 1, a transporting protrusion 4 is spirally provided in the interior wall of the toner container. However, the spiral transporting protrusion 4 is not arranged continuously from the right end to the left end in the toner container of the present invention. As shown, at least one intermittent portion 3 is provided and also the transporting protrusion 4 is formed at an inclined angle to some extent against the rotating axis.

Accordingly, via rotation of the toner container, the toner is stably transported in the direction of the toner discharge port. Further, via the intermittent presence of the transporting protrusion 4, turbulence or shock can be applied, to some extent, to the toner filled in the toner container during transportation, resulting in an advantageous effect in pulverizing a toner having been granulated (aggregated) during toner storage and in eliminating uneven distribution of the toner components in the toner container.

Further, it is preferable to appropriately determine the shape and height/length of the transporting protrusion 4 and the space (length) of the portion 3, which is intermittently present, according to the rotating rate of the toner container and toner properties, but an angle of the transporting protrusion 4 in the toner container to the rotating axis of the toner container is preferably from 20-80 degrees. Namely, when the cylindrical side wall of the toner container is unrolled, the angle between the longitudinal direction of the transporting protrusion 4 and a line parallel to the rotation axis is preferably 20-80 degrees on the unrolled plane of the side wall. The transporting protrusion 4 may be curved along the longitudinal direction on an unrolled plane of the side wall.

With regard to the toner containers shown in FIGS. 1-5, the toner containers shown in FIGS. 1-3 are examples of the present invention, and in contrast, the toner containers shown in FIGS. 4 and 5 are outside of the aspects of the present invention since the transporting protrusion 4 has a continuous shape as shown in FIG. 4 and also the angle of the transporting protrusion 4 to the rotating axis is less than 20 degrees (parallel to the rotating axis) as shown in FIG. 5.

[Toner Materials Used in the Present Invention]

Production methods of the toner used in the present invention are not specifically limited and any appropriate methods known in the art are employable.

However, from the viewpoint of producing a toner exhibiting a low glass transition temperature (Tg), as well as exhibiting excellent feed stability, transferability, and cleaning properties, a toner produced via a so-called polymerization method is preferable, but in such a toner, one incorporating spherical and nonspherical toner particles is specifically preferable. A production method of the toner is characterized in that, while resin particles are aggregated, resin particles of a glass transition temperature different from that of the initially added resin particles are added in an aggregation process of the resin particles and aggregation is further continued, wherein the glass transition temperature of the secondly added resin particles is preferably higher than that of the initially added resin particles.

A production method of the toner will now be described, in which resin particles are initially synthesized and then core/shell-type toner particles are produced via salting-out/fusion/association thereof.

The toner of the present invention is composed of a resin and a colorant, incorporating a mixture of a spherical and a nonspherical toner, as described above. The small diameter toner usable in the present invention, capable of precisely reproducing minute-dot images, is preferably prepared via polymerization methods in which the operation of controlling the particle diameter or the shape can be conducted in the production process. Of these, an emulsion association method may be one of the effective methods wherein resin particles having primary particle diameters of 60-300 nm is initially formed via an emulsion polymerization method or a suspension polymerization method, followed by a process of aggregating these resin particles.

In the present invention, it was found that, when a toner is prepared via the emulsion association method, a spherical toner and the above nonspherical toner are simultaneously formed via the following operation in the aggregation process of a resin particle. Namely, the operation is one in which, while a resin particle is aggregated, another resin particle is added thereto and the aggregation is further continued. Specifically, while a resin particle is aggregated, another resin particle featuring a glass transition temperature different from that of the initially added resin particle is added, and the aggregation is further continued. Herein, the glass transition temperature of the secondly added resin particle is preferably higher than that of the initially added resin particle.

Preparation of a toner via an emulsion association method will now be described, which is one example of the production methods of the toner of the present invention. The preparation of the toner via the emulsion association method is carried out via the following processes.

(1) Preparation process of a resin particle A dispersion
(2) Preparation process of a resin particle B dispersion
(3) Preparation process of a colorant particle dispersion
(4) Aggregation/fusion process of resin particles
(5) Ripening process
(6) Cooling Process
(7) Washing process
(8) Drying process
(9) External additive treatment process Each of the processes will now be described.

(1) Preparation Process of a Resin Particle A Dispersion

Resin particle A refers to a resin particle which is initially added to a reaction system in an aggregation process to be described later. This process is one in which a polymerizable monomer to form resin particle A is added into an aqueous medium, followed by polymerization to form resin particles of about 120 nm. Resin particle A containing wax may be formed. In this case, initially, wax is dissolved or dispersed in a polymerizable monomer, followed by being polymerized in an aqueous medium to form resin particles containing the wax.

(2) Preparation Process of a Resin Particle B Dispersion

Resin particle B refers to a resin particle which is added while resin particle A is aggregated which has been initially added to the reaction system in the aggregation process to be described later. A preparation method of resin particle B is basically the same as that of resin particle A, but a resin particle is formed which features a glass transition temperature different from that of resin particle A. In the preparation method of resin particle B, a resin particle is preferably formed, which features a higher glass transition temperature than that of resin particle A.

(3) Preparation Process of a Colorant Particle Dispersion

This process is one in which a colorant is dispersed in an aqueous medium to prepare a colorant particle dispersion of about 110 nm.

(4) Aggregation/fusion Process of Resin Particles

This process is one in which resin particles and colorant particles are aggregated in an aqueous medium and these aggregated particles are fused for particle formation. This process is an "aggregation process of resin particles" which is designated by the present invention.

In this process, an alkali metal salt or an alkaline earth metal salt, serving as an aggregating agent, is added in an aqueous medium containing the resin particles and the colorant particles. Thereafter, aggregation is promoted by heating to at least the glass transition temperature of the resin particles, as well as to at least the melting peak temperature (° C.) of the resultant mixture, and at the same time, the resin particles are fused each other.

In this process, the toner of the present invention can be prepared, which is composed of a mixture of a spherical toner and a nonspherical toner, via the following particle formation procedures.

Namely, initially, resin particle A and the colorant particles, having been prepared via the above procedures, are added to the reaction system and then an aggregating agent such as magnesium chloride is added thereto, followed by aggregation of resin particle A for particle formation. Subsequently, while resin particle A is aggregated, resin particle B of a glass transition temperature different from that of initially added resin particle A is added, and the aggregation of the resin particles is further continued.

Further, it is preferable that the resin particles are added when the size of an aggregate, incorporating initially added resin particle A, reaches 30%-50% of the volume-based median diameter (D50) of the targeted toner.

Then, when the particle diameter of the particles reaches the targeted size, a salt such as common salt is added to terminate the aggregation. Herein, an amount of resin particle B added is preferably from 2-90% by mass based on resin particle A.

(5) Ripening Process

This process is one, which follows the aggregation/fusion process, ripens the particles until the shape thereof reaches a desired average circularity via heating treatment of the reaction system.

(6) Cooling Process

This process is one in which the particle dispersion is subjected to cooling (rapid cooling). Cooling is carried out at a cooling rate of 1-20° C./minute for a cooling condition.

Cooling methods therefor are not specifically limited, including, for example, a cooling method via introduction of a cooling medium from the exterior of the reaction container, as well as a cooing method via direct pouring of cooled water in the reaction system.

(7) Washing Process

This process incorporates a process of solid-liquid separation of particles from the particle dispersion, which has been cooled down to a predetermined temperature in the above process, as well as a washing process to remove deposits such as a surfactant and an aggregating agent from the particles, which have been formed into a wet cake aggregate via the solid-liquid separation.

In the washing process, water washing is carried out until the electric conductivity of the filtrate reaches 10 μS/cm. Filtration methods include a centrifugal separation method, a vacuum filtration method carried out employing a Buchner funnel, and a filtration method carried out employing a filter press, but the filtration methods are not specifically limited.

(8) Drying Process

This process is one in which dried particles are prepared by drying the washed particles. Examples of driers used in this process include spray driers, vacuum freeze driers, and vacuum driers. It is preferable to use any of the stationary tray drier, transportable tray drier, fluid layer drier, rotary type drier, and stirring type drier.

The moisture in the dried particles is preferably at most 5% by mass, but is more preferably at most 2% by mass. Incidentally, when the dried particles are aggregated via weak attractive force thereamong, the aggregate may be pulverized. Herein, mechanical pulverizing apparatuses such as a jet mill, a HENSCHEL mixer, a coffee mill, or a food processor may be used as a pulverizing method.

(9) External Additive Treatment Process

This process is one in which a toner is prepared by mixing external additives with the dried particles, if appropriate. Mechanical mixers such as a HENSCHEL mixer or a coffee mill may be used as a mixer for the external additives.

The resins of the present invention are those which contain polymers, as constituent components, prepared by polymerizing at least one type of polymerizable monomer. The polymerizable monomers include styrene or styrene derivatives such as styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, or p-n-dodecylstyrene; methacrylate derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, or dimethylaminoethyl methacrylate; acrylate derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, or phenyl acrylate; olefins such as ethylene, propylene, or isobutylene; vinyl esters such as vinyl propionate, vinyl acetate, or vinyl benzoate; vinyl ethers such as vinyl methyl ether or vinyl ethyl ether; vinyl ketones such as vinyl methyl ketone, vinyl ethyl ketone, or vinyl hexyl ketone; N-vinyl compounds such as N-vinylcarbazole, N-vinylindole, or N-vinylpyrrolidone; vinyl compounds such as vinylnaphthalene or vinylpyridine; and acrylic or methacrylic acid derivatives such as acrylonitrile, methacrylonitrile, or acrylamide. These vinyl-based monomers may be used individually or in combination.

It is further possible to use those having an ionic dissociating group as a polymerizable monomer constituting the resins. As examples thereof, cited are ones having a substituent such as a carboxyl group, a sulfonic acid group, or a phosphoric acid group as a constituent group of the monomer. Specific examples include acrylic acid, methacrylic acid, maleic acid, itaconic acid, cinnamic acid, fumaric acid, a monoalkyl maleate, a monoalkyl itaconate, styrene sulfonic acid, allylsulfosuccinic acid, 2-acrylamido-2-methylpropanesulfonic acid, and acid phosphoxyethyl methacrylate.

It is also possible to prepare crosslinking-structured resins employing polyfunctional vinyls such as divinylbenzene, ethylene glycol dimethacrylate, or ethylene glycol diacrylate.

As colorants usable for the toner of the present invention, any appropriate ones known in the art are exemplified. Specific colorants are listed below.

Examples used as a black colorant include carbon blacks such as furnace black, channel black, acetylene black, thermal black, or lamp black, as well as magnetic powders such as magnetite or ferrite.

Colorants for magenta or red include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Further, colorants for orange or yellow include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, and C.I. Pigment Yellow 138.

Still further, colorants for green or cyan include C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Blue 62, C.I. Pigment Blue 66, and C.I. Pigment Green 7.

These colorants may be used individually or in combinations of at least selected two types. Further, the amount of colorants added is commonly from 1-30% by mass, preferably from 2-20% by mass based on the total toner mass.

As waxes usable for the toner of the present invention, any appropriate ones known in the art are exemplified. Specific examples of thereof include polyolefin waxes such as polyethylene wax or polypropylene wax; long chain hydrocarbon-based waxes such as paraffin wax or Sasol wax; dialkyl ketone-based waxes such as distearyl ketone; ester-based waxes such as carnauba wax, montan wax, trimethylolpropane tribehenate, pentaerythritol tetramyristate, pentaerythritol tetrastearate, pentaerythritol tetrabehenate, pentaerythritol diacetate dibehenate, glycerin tribehenate, 1,18-octadecanediol distearate, tristearyl trimelliate, distearyl maleate; and amide-based waxes such as ethylenediaminedibehenylamide or trimellitic acid tristearylamide.

The melting point of a wax used is commonly from 40-160° C., preferably from 50-120° C., more preferably from 60-90° C. By allowing the melting point to be within the range, heat-resistant storage properties of the toner are secured, and also stable formation of toner images is carried out in such a manner that no cold offsetting occurs even during low temperature fixing. Further, the wax content in the toner is preferably from 1% by mass-30% by mass, more preferably from 5% by mass-20% by mass.

[Image Forming Method and Image Forming Apparatus of the Present Invention]

The toner of the present invention may be used as a single-component developer or a two-component developer, but is preferably used as a two-component developer.

Further, an image forming method, which can employ the toner of the present invention, will now be described. The toner of the present invention is used, for example, in a high-speed image forming apparatus featuring a print speed level of 100-400 mm/second (namely, an output performance of 65-85 sheets/minute in terms of A4 transfer paper). Specifically, exemplified is a printer capable of preparing a large amount of documents in a short time via on-demand production. In the present invention, the toner can further be applied to an image forming method featuring a fixing roller temperature of at most 120° C., preferably at most 100° C.

The reason is that the glass transition temperature of the toner of the present invention is from 16-44° C.

Figure 6:
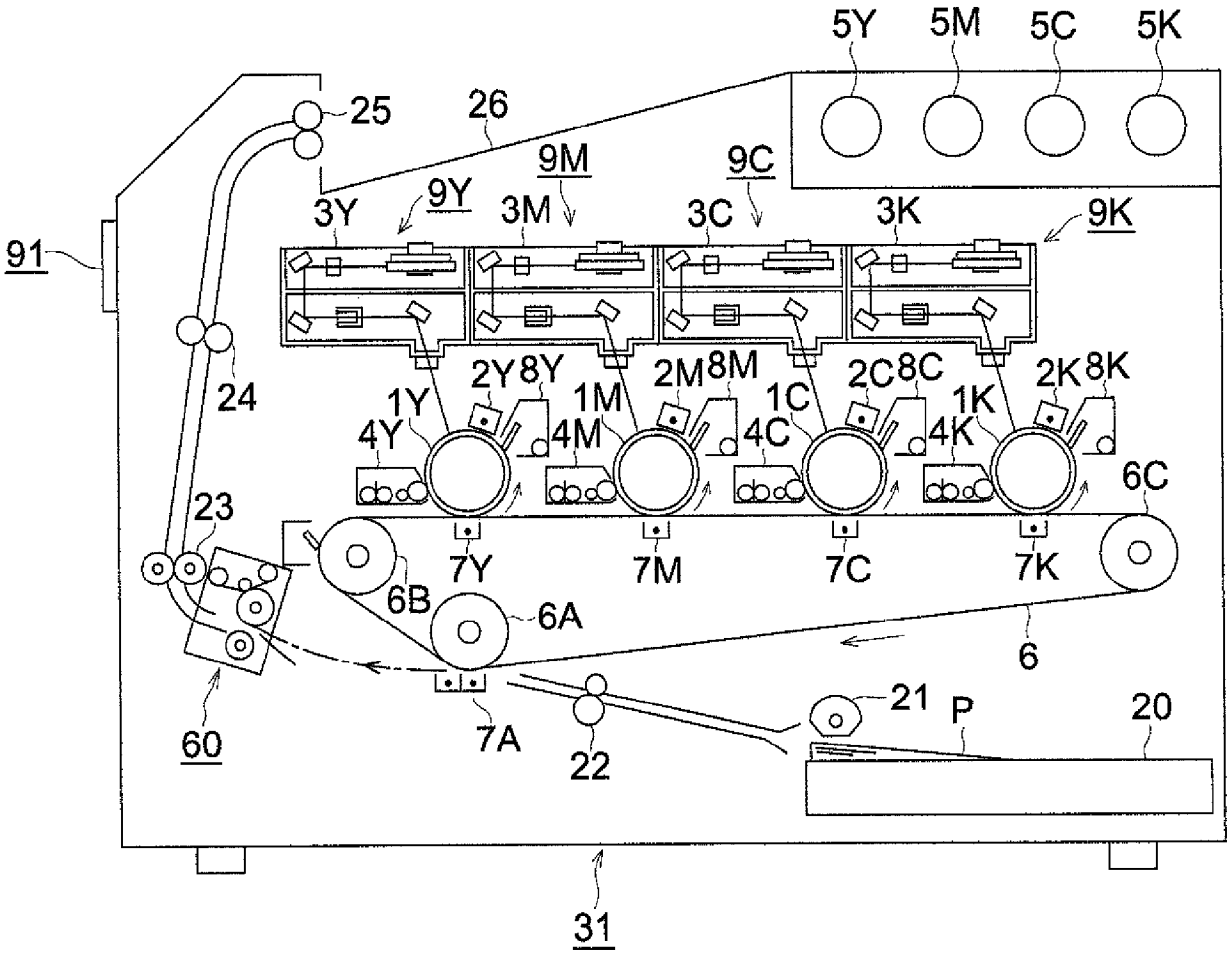
FIG. 6 illustrate a cross-sectional view of an image forming apparatus capable of employing the toner of the present invention

FIG. 6 shows a schematic cross-sectional view of one example of the image forming apparatus that can employ the toner of the present invention.

As shown in FIG. 6, this image forming apparatus 31 is called a tandem system color image forming apparatus, structured in such a manner that plural groups of image forming units 9Y, 9M, 9C, and 9k, are arranged along with a belt type intermediate transfer medium 6, a paper feed member, a transportation member, toner containers 5Y, 5M, 5C, and 5K, as well as a fixing device 60 and an operating section 91 of the present invention.

The image forming unit 9Y, forming yellow images, is provided with a charging member 2Y, an exposing member 3Y, a developing device 4Y, a transfer member 7Y, and a cleaning member 8Y arranged on the outer circumference of an image carrier (hereinafter, referred to as a photoreceptor) 1Y.

The image forming unit 9M, forming magenta images, is provided with a photoreceptor 1M, a charging member 2M, an exposing member 3Y, a developing device 4M, a transfer member 7M, and a cleaning member 8M.

The image forming unit 9C, forming cyan images, is provided with a photoreceptor 1C, a charging member 2C, an exposing member 3C, a developing device 4C, a transfer member 7C, and a cleaning member 8C.

The image forming unit 9K, forming black images, is provided with a photoreceptor 1K, a charging member 2K, an exposing member 3K, a developing device 4K, a transfer member 7K, and a cleaning member 8K.

The intermediate transfer medium 6 is wounded around a plurality of rollers 6A, 6B, and 6C, and held so as to rotate.

Images of each color, formed in the image forming units 9Y, 9M, 9C, and 9K, are primarily transferred individually onto the rotating intermediate transfer medium 6 by the transfer members 7Y, 7M, 7C, and 7K to form composite color images.

Paper sheets P stored in a paper feed cassette 20, serving as a paper feed member, are fed singly by a paper feed roller 21 and conveyed to a transfer member 7A through a registration roller 22, whereby the color images are secondarily transferred onto each of the paper sheets P.

The paper sheet P, on which the color images have been transferred, is subjected to fixing by the fixing device 60, which is the fixing device of the present invention. After passing through transportation rollers 23 and 24, serving as transportation members, the paper sheet is clamped by a paper discharge roller 25, followed by being placed on a paper discharge tray 26 located outside the apparatus.

EXAMPLES

Embodiments of the present invention will now be specifically described with reference to examples, however, the present invention is not limited thereto.

1. Preparation of Toners

The toners were prepared as follows.

(1) Preparation of Colored Particle 1

(Preparation of Resin Particle A1)

A reaction container fitted with a stirrer, a thermal sensor, a cooling pipe, and a nitrogen introducing unit was charged with 8 parts by mass of sodium dodecylsulfate and 3000 parts by mass of ion-exchanged water, and while stirring at 230 rpm under a nitrogen flow, the interior temperature was increased to 80° C. After the rise in temperature, a polymerization initiator solution, prepared by dissolving 10 parts by mass of potassium persulfate in 200 parts by mass of ion-exchanged water, was added, and then the liquid temperature was adjusted to 80° C.

Further, a polymerizable monomer liquid mixture, containing the compounds listed below, was dripped into the reaction container over 1 hour, and polymerization was conducted by heating at 80° C. over 2 hours while stirring to give a resin particle. This resin particle was designated as "resin particle (1H1)."

| | |
|---|---|
| Styrene | 480 parts by mass |
| n-Butyl acrylate | 250 parts by mass |
| Methacrylic acid | 68 parts by mass |
| n-Octyl-3-mercaptopropionate | 16 parts by mass |

A reaction container fitted with a stirrer, a thermal sensor, a cooling pipe, and a nitrogen introducing unit was charged with a solution, prepared by dissolving 7 parts by mass of polyoxyethylene(2)sodium dodecylethersulfate in 800 parts by mass of ion-exchanged water. The reaction container was heated to 98° C., and then 260 parts by mass of above "resin particle (1H1)" and a polymerizable monomer liquid mixture containing the compounds, listed below, were added as such. The resultant mixture was mixed and dispersed for 1 hour using mechanical-system homogenizer "CLEARMIX" fitted with a circulatory path (produced by M Technique Co., Ltd.) to prepare a dispersion containing emulsified particles (oil droplets).

| | |
|---|---|
| Styrene | 245 parts by mass |
| n-Butyl acrylate | 120 parts by mass |
| n-Octyl-3-mercaptopropionate | 1.5 parts by mass |
| Polyethylene wax (melting point: 81° C.) | 190 parts by mass |

Subsequently, there was added a polymerization initiator solution, prepared by dissolving 6 parts by mass of potassium persulfate in 200 parts by mass of ion-exchanged water, to the resultant dispersion, followed by heating at 82° C. for 1 hour while stirring to give a resin particle via polymerization. The resulting resin particle was designated as "resin particle (1HM1)."

Further, a polymerization initiator solution, prepared by dissolving 11 parts by mass of potassium persulfate in 400 parts by mass of ion-exchanged water, was added, and a polymerizable monomer solution, containing the compounds listed below, was dripped over 1 hour at 82° C. After dripping, polymerization was conducted by heating over 2 hours while stirring, followed by being cooled to 28° C. to give a resin particle. This resin particle was designated as "resin particle A1." The glass transition temperature of "resin particle A1" thus obtained was 28° C.

| | |
|---|---|
| Styrene | 435 parts by mass |
| n-Butyl acrylate | 130 parts by mass |
| Methacrylic acid | 33 parts by mass |
| n-Octyl-3-mercaptopropionate | 8 parts by mass |

(Preparation of Resin Particle B)

A reaction container fitted with a stirrer, a thermal sensor, a cooling pipe, and a nitrogen introducing unit was charged with 2.3 parts by mass of sodium dodecylsulfate and 3000 parts by mass of ion-exchanged water, and while stirring at 230 rpm under a nitrogen flow, the interior temperature was heated to 80° C. After the rise in temperature, a solution, prepared by dissolving 10 parts by mass of potassium persulfate in 200 parts by mass of ion-exchanged water, was added. The liquid temperature was again heated to 80° C. and a polymerizable monomer liquid mixture, containing the compounds listed below, was dripped over 1 hour. After dipping, polymerization was conducted by heating over 2 hours while stirring, followed by being cooled to 28° C. to give a resin particle. This resin particle was designated as "resin particle B." The glass transition temperature of "resin particle B" thus obtained was 48° C.

| | |
|---|---|
| Styrene | 520 parts by mass |
| n-Butyl acrylate | 210 parts by mass |
| Methacrylic acid | 68 parts by mass |
| n-Octyl-3-mercaptopropionate | 16 parts by mass |

(Preparation of Colorant Dispersion 1)

Ninety parts by mass of sodium dodecylsulfate was added in 1600 parts by mass of ion-exchanged water. While stirring this solution, 420 parts by mass of carbon black ("REGAL 330R", produced by Cabot Corp.) was added gradually, followed by being dispersed using homogenizer "CLEARMIX" (produced by M Technique Co., Ltd.) to prepare a colorant particle dispersion. This dispersion was designated as "colorant dispersion 1." The particle diameter of the colorant particles in "colorant dispersion 1" was determined to be 110 nm using electrophoretic light scattering spectrophotometer "ELS-800" (produced by Otsuka Electronics Co., Ltd.).

(Aggregation/Fusion) Process)

A reaction container fitted with a stirrer, a thermal sensor, a cooling pipe, and a nitrogen introducing unit was charged with the following compounds and the liquid temperature was adjusted to 30° C.

| | |
|---|---|
| "Resin particle A1" (in terms of the solid content) | 300 parts by mass |
| Ion-exchange water | 1400 parts by mass |
| "Colorant dispersion 1" | 120 parts by mass |

There was added an aqueous solution, prepared by adding 3 parts by mass of polyoxyethylene(2)sodium dodecylethersulfate in 120 parts by mass of ion-exchange water to the resultant mixture, followed by addition of a 5 mol/l sodium hydroxide aqueous solution to adjust pH to 10. Subsequently, an aqueous solution of 30° C., prepared by dissolving 35 parts by mass of magnesium chloride in 35 parts by mass of ion-exchange water, was added to the reaction system over 10 minutes while stirring. Further, after a lapse of 3 minutes from the addition, temperature elevation was initiated and then the reaction system was heated to 90° C. over 60 minutes to promote aggregation. The size of particles formed via aggregation was observed using "MULTISIZER 3."

When the volume-based median diameter (D50) reached 3.1 μm, 260 parts by mass (in terms of the solid content) of "resin particle B" was added. The aggregation was further continued, and when the volume-based median diameter (D50) reached 6.5 μm, 750 parts by mass of a 20% sodium chloride aqueous solution was added to terminate the aggregation.

After addition of the 20% sodium chloride aqueous solution, the liquid temperature was elevated to 98° C. with stirring continued. As the average circularity of particles was observed using flow-system particle image analyzer "FPIA-2100", fusion of aggregated resin particles was continued. When the average circularity thereof reached 0.965, the liquid temperature was cooled to 30° C., and pH was adjusted to 4.0 via addition of hydrochloric acid, followed by termination of the stirring.

(Washing/Drying Process)

The particles formed via the aggregation/fusion process were subjected to solid/liquid separation using basket type centrifuge "MARK III TYPE MODEL No. 60×40" (produced by Matsumoto Kikai Mfg. Co., Ltd.) to give a wet cake of the particles. The wet cake was washed with ion-exchanged water of 45° C. using the above basket type centrifuge until the electric conductivity of the filtrate reached 5 μS/cm. Thereafter, the resultant cake was placed in "FLASH JET DRYER" (produced by Seishin Enterprise Co., Ltd.) and dried until the water content reached 0.5% by mass to give colored particle 1. In addition, as to colored particle 1, after sampling 128 particles at random, the shape was measured from a micrograph taken at a magnification of 2000 times, and particles having a ratio of the $2^{nd}$ short axis to the $1^{st}$ axis being 1.1-1.6 had a quantity of 46.9% in terms of the number of particles.

(2) Preparation of Colored Particle 2

(Preparation of Resin Particle A2)

A reaction container fitted with a stirrer, a thermal sensor, a cooling pipe, and a nitrogen introducing unit was charged with 8 parts by mass of sodium dodecylsulfate and 3000 parts by mass of ion-exchanged water, and while stirring at 230 rpm under a nitrogen flow, the interior temperature was heated to 80° C. After the rise in temperature, a polymerization initiator solution, prepared by dissolving 10 parts by mass of potassium persulfate in 200 parts by mass of ion-exchanged water, was added, and then the liquid temperature was adjusted to 80° C.

Subsequently, a polymerizable monomer liquid mixture, containing the compounds listed below, was dripped into the reaction container over 1 hour, and polymerization was conducted by heating at 80° C. over 2 hours while stirring to give a resin particle. This resin particle was designated as "resin particle (1H2)."

| | |
|---|---|
| Styrene | 495 parts by mass |
| n-Butyl acrylate | 235 parts by mass |
| Methacrylic acid | 68 parts by mass |
| n-Octyl-3-mercaptopropionate | 16 parts by mass |

A reaction container fitted with a stirrer, a thermal sensor, a cooling pipe, and a nitrogen introducing unit was charged with a solution prepared by dissolving 7 parts by mass of polyoxyethylene(2)sodium dodecylethersulfate in 800 parts by mass of ion-exchange water. The reaction container was heated to 98° C., and then 260 parts by mass of above "resin particle (1H)" and a polymerizable monomer liquid mixture containing the compounds, listed below, were added as such. The resultant mixture was mixed and dispersed for 1 hour using mechanical-system homogenizer "CLEARMIX" fitted with a circulatory path (produced by M Technique Co., Ltd.) to prepare a dispersion containing emulsified particles (oil droplets).

| | |
|---|---|
| Styrene | 250 parts by mass |
| n-Butyl acrylate | 115 parts by mass |
| n-Octyl-3-mercaptopropionate | 1.5 parts by mass |
| Polyethylene wax (melting point: 81° C.) | 190 parts by mass |

Subsequently, a polymerization initiator solution, prepared by dissolving 6 parts by mass of potassium persulfate in 200 parts by mass of ion-exchanged water, was added to this dispersion, followed by polymerization via heating treatment at 82° C. for 1 hour while stirring to give a resin particle. This resin particle was designated as "resin particle (1HM2)."

Further, a polymerization initiator solution, prepared by dissolving 11 parts by mass of potassium persulfate in 400 parts by mass of ion-exchanged water, was added, and a polymerizable monomer solution, containing the compounds listed below, was dripped over 1 hour at 83° C. After dripping, polymerization was conducted by heating for 2 hours while stirring and then cooled to 28° C. to give a resin particle. This resin particle was designated as "resin particle A2." The glass transition temperature of "resin particle A2" thus obtained was 40° C.

| | |
|---|---|
| Styrene | 435 parts by mass |
| n-Butyl acrylate | 130 parts by mass |
| Methacrylic acid | 33 parts by mass |
| n-Octyl-3-mercaptopropionate | 8 parts by mass |

In the subsequent operations, "colored particle 2" was prepared using "resin particle B" and the "colorant dispersion", having been used in preparation of "colored particle 1", with all other things remaining the same as for "colored particle 1." In addition, as to colored particle 2, after sampling 128 particles at random, the shape was measured from a micrograph taken at a magnification of 2000 times, and particles having a ratio of the $2^{nd}$ short axis to the $1^{st}$ axis being 1.1-1.6 had a quantity of 6.3% in terms of the number of particles.

(External Additive Treatment Process)

External additives (silica particles, titanium oxide, and composite metal oxide particles) were added to 100 parts of each of "colored particle 1" and "colored particle 2" as listed in Table 1 shown below.

The resultant mixture was mixed at 25° C. for 25 minutes at 40 m/second using "10 L HENSCHEL MIXER" (produced by Mitsui Miike Engineering Co., Ltd.). After mixing, coarse particles were removed using a sieve of a 45 μm opening to prepare "Toners 1-1-1-8" and "Toners 2-1-2-8" from "colored particle 1" and "colored particle 2", respectively. The glass transition temperature (Tg) of each of "Toners 1-1-1-8" was 32° C. and the glass transition temperature (Tg) of each of "Toners 2-1-2-8" was 42° C. In addition, as to "Toners 1-1-1-11", particles having a ratio of the $2^{nd}$ short axis to the $1^{st}$ axis being 1.1-1.6 had the same quantity in terms of the number of particles as that of colored particle 1. Similarly, as to "Toners 2-1-2-11", particles having a ratio of the $2^{nd}$ short axis to the $1^{st}$ axis being 1.1-1.6 had the same quantity in terms of the number of particles as that of colored particle 2.

In Table 1, with regard to "Toners 1-1-1-8" and "Toners 2-1-2-8", there are shown the external additive compositions, the x-ray intensity ratios (Ti/Si) of titanium to silicon after addition of the external additives, which were determined via X-ray fluorescence spectrometry, and the conveyance indices.

TABLE 1

| | External Additive | | | | | | Ti/Si Ratio in Toner (X-ray | | Glass |
|---|---|---|---|---|---|---|---|---|---|
| | Silica | | | | Titanium | Composite Metal | Fluorescence Spectroscopic | conveyance index | Transition Temperature |
| Toner No. | Silica A (10 nm) | Silica B (12 nm) | Silica C (15 nm) | Silica D (30 nm) | Oxide (20 nm) | Oxide (50 nm) | Intensity) (Ti/Si) | of Toner | of Toner (° C.) |
| 1-1 | 1.10 | — | — | 0.50 | 0.40 | 0 | 0.52 | 15.5 | 30 |
| 1-2 | — | 0.60 | — | 0.75 | 0.80 | 0 | 1.08 | 9.2 | 30 |
| 1-3 | — | — | 1.30 | — | 0.60 | 0.60 | 0.95 | 20.4 | 30 |
| 1-4 | — | 1.00 | — | — | 0.60 | 0.80 | 2.40 | 8.1 | 30 |
| 1-5 | — | — | 1.00 | — | 0.40 | 0.80 | 1.53 | 7.8 | 30 |
| 1-6 | — | — | 1.30 | — | 0.40 | 0.80 | 1.10 | 4.9 | 30 |
| 1-7 | — | — | 1.30 | — | 0.60 | 0.80 | 1.64 | 4.4 | 30 |
| 1-8 | — | — | 1.00 | — | 1.50 | 0.60 | 3.05 | 2.2 | 30 |
| 2-1 | 1.10 | — | — | 0.50 | 0.40 | 0 | 0.51 | 13.7 | 42 |
| 2-2 | — | 0.60 | — | 0.75 | 0.80 | 0 | 0.98 | 11.8 | 42 |
| 2-3 | — | — | 1.30 | — | 0.60 | 0.60 | 1.03 | 17.6 | 42 |
| 2-4 | — | 1.00 | — | — | 0.60 | 0.80 | 2.37 | 5.4 | 42 |
| 2-5 | — | — | 1.00 | — | 0.40 | 0.80 | 1.52 | 3.7 | 42 |
| 2-6 | — | — | 1.30 | — | 0.40 | 0.80 | 1.17 | 4.1 | 42 |

TABLE 1-continued

| | External Additive | | | | | | Ti/Si Ratio in Toner (X-ray | | Glass |
|---|---|---|---|---|---|---|---|---|---|
| | Silica | | | | Titanium | Composite Metal | Fluorescence Spectroscopic | conveyance index | Transition Temperature |
| Toner No. | Silica A (10 nm) | Silica B (12 nm) | Silica C (15 nm) | Silica D (30 nm) | Oxide (20 nm) | Oxide (50 nm) | Intensity) (Ti/Si) | of Toner | of Toner (° C.) |
| 2-7 | — | — | 1.30 | — | 0.60 | 0.80 | 1.66 | 3.8 | 42 |
| 2-8 | — | — | 1.00 | — | 1.50 | 0.60 | 2.93 | 1.7 | 42 |

Number average primary particle diameters are shown in parentheses; and Each amount of External Additive represents mass part added to 100 mass parts of Colorant 1 or Colorant 2

Silica A described in Table 1 is prepared via a dry method, and has silica particles having a primary particle diameter of 10 nm which have been subjected to a surface treatment with octylmethoxysilane. Similarly, Silica B described in Table 1 is also prepared via a dry method, and is silica particles having a primary particle diameter of 12 nm which have been subjected to a hydrophobic treatment with 1,1,1,3,3,3-hexamethyldisilazane. Further, Silica C described in Table 1 is prepared via a dry method, and is silica particles having a primary particle diameter of 15 nm which have been subjected to a hydrophobic treatment with 1,1,1,3,3,3-hexamethyldisilazane. In the same way, Silica D described in Table 1 is prepared via a dry method, and is silica particles having a primary particle diameter of 30 nm which have been subjected to a hydrophobic treatment with 1,1,1,3,3,3-hexamethyldisilazane. On the other hand, titanium dioxide described in Table 1 is anatase-type titanium dioxide particles having a primary particle diameter of 20 nm. Composite metal oxide is composite metal oxide particles containing titanium and silicon, which have been subjected to a hydrophobic treatment with a hexamethyldisilane compound, and has a structure in which crystallized titanium dioxide is present on the surface of a core made of amorphous silica. In this case, an X-ray intensity ratio of Ti to Si determined via fluorescent X-ray analysis was 2.87.

[Evaluation for Toner Bottle (Combination of Toner and Toner Container)]

Properties of Toner bottles 1-1 through 1-10 and 2-1 through 2-10 obtained by the combinations of the toner and the toner container listed in Table 2 were evaluated using an image forming apparatus having the constitution shown in FIG. 6.

(Evaluation Method)

Presence or Absence of Granulated Toner Particles

A toner was Filled in each of the toner containers and stored at 40° C. at 95% RH for 1000 hours.

After that, toner was collected from each container. The amount of the collected toner was the same as the amount consumed when an image having a high image ratio of 85% was continuously printed on 200 sheets of A4-size paper, which corresponds to a printing mode of high toner exchange rate, Then, presence or absence of incorporation of granulated toner particles in thus-collected toner was evaluated with the naked eye and through a 50× loupe.

A: No incorporation of granulated toner particles is noted: excellent.

B: A small numbers of granulated toner particles are noted through the loupe: practically not problematic.

C: Granulated toner particles are noted even with the naked eye: practically problematic.

Toner Density Nonuniformity

Using the toner having been filled and stored in each toner container in the same manner as above, an image evenly having a white portion and a solid image portion of about 0.80 density was continuously printed on 5000 sheets of A4-size paper. Then, the printed image after the 5000 sheets printing was evaluated.

A: No spots or density nonuniformity due to granulated toner particles is observed: excellent.

B: A small numbers of spots in the image portion due to granulated toner particles are observed: practically not problematic.

C: Spots due to granulated toner particles are observed even in the white portion: practically problematic.

High Toner Consumption Mode Fog

Fog was evaluated as follows:

An image having a high image ratio of 85% was continuously printed on 200 sheets of A4-size paper, which corresponds to a printing mode of high toner exchange rate (high toner consumption mode). Then, the image density of a non-image portion, namely, fog, of the 200th print was evaluated.

Absolute image densities at 20 random points on an unprinted sheet of paper (namely white paper) were measured and averaged to obtain a white paper density. Thereafter, similarly, absolute image densities at 20 random points on the white portion of the evaluating sheet on which solid image printing was carried out were measured to obtain an average density. The white paper density was subtracted from the average density to obtain a value which was evaluated as the fog density. Herein, the measurement described above was carried out using "RD-918" (Macbeth Reflective Densitometer).

Evaluation Criteria

A: Fog density is at most 0.005: excellent.

B. Fog density is at most 0.01: practically not problematic.

C: Fog density is more than 0.01: practically problematic.

Halftone Image Uniformity (Halftone Density Non-Uniformity)

The halftone density nonuniformity was evaluated as the density difference (namely, "the maximum density"-"the minimum density") in a halftone image (at a density of about 0.40).

A: Density difference is at most 0.05: excellent.

B: Density difference is more than 0.05 and less than 0.1: practically not problematic.

C: Density difference is at least 0.1: practically problematic.

TABLE 2

| Toner Bottle No. | Transportation Protrusion Shape of Toner Container | Toner No. | Feed Stability: Toner Granulation 200 Sheets Printing | Feed Stability: Toner Density Nonuniformity 5000 Sheets Printing | Image Stability: High Consumption Mode Fog 200 Sheets Printing | Image Stability: Half Tone Image Uniformity 5000 Sheets Printing | Remarks |
|---|---|---|---|---|---|---|---|
| 1-1 | FIG. 1 | 1-1 | B | B | C | C | Comp. |
| 1-2 | FIG. 2 | 1-2 | B | B | B | B | Inv. |
| 1-3 | FIG. 3 | 1-3 | A | B | C | B | Comp. |
| 1-4 | FIG. 1 | 1-4 | B | B | B | B | Inv. |
| 1-5 | FIG. 1 | 1-5 | B | B | B | B | Inv. |
| 1-6 | FIG. 1 | 1-6 | A | A | A | B | Inv. |
| 1-7 | FIG. 1 | 1-7 | A | A | A | A | Inv. |
| 1-8 | FIG. 4 | 1-7 | C | — | — | — | Comp. |
| 1-9 | FIG. 5 | 1-7 | B | C | B | C | Comp. |
| 1-10 | FIG. 1 | 1-8 | B | B | C | C | Comp. |
| 2-1 | FIG. 1 | 2-1 | B | B | C | C | Comp. |
| 2-2 | FIG. 2 | 2-2 | A | A | B | C | Comp. |
| 2-3 | FIG. 3 | 2-3 | A | A | C | B | Comp. |
| 2-4 | FIG. 1 | 2-4 | A | A | B | B | Inv. |
| 2-5 | FIG. 1 | 2-5 | B | B | B | B | Inv. |
| 2-6 | FIG. 1 | 2-6 | A | A | A | A | Inv. |
| 2-7 | FIG. 1 | 2-7 | A | A | A | A | Inv. |
| 2-8 | FIG. 4 | 2-7 | C | — | — | — | Comp. |
| 2-9 | FIG. 5 | 2-7 | B | C | B | C | Comp. |
| 2-10 | FIG. 1 | 2-8 | B | B | C | C | Comp. |

Inv.: Inventive,
Comp.: Comparative
"—" means "impossible to measure."

By controlling the Ti/Si ratio and the conveyance index (as well as the shape of toner particle) within the range of the present invention, no density deterioration was observed even after solid images were continuously formed; no fog was observed even in a mode in which the stirring time of the toner in a developing device was varied due to heavy-duty consumption; and the non-uniformity of halftone density was minimized since the toner was transferred to an image forming apparatus while maintaining high transferability of the toner, whereby degradation of transferability could be minimized even in the image forming apparatus.

Table 2 clearly shows that none of the properties is practically problematic for the inventive samples, while at least one of the properties is practically problematic for the comparative samples.

What is claimed is:

1. A toner bottle comprising a cylindrical toner container having therein a toner comprising at least a resin, a colorant and an external additive, the toner container having a toner discharge port on an end thereof and a rotation axis along the cylindrical toner container, and the toner container being installable in an image forming apparatus, wherein the toner container has plural protrusions which are intermittently provided in an interior of the cylindrical container, the protrusions having a function to convey the toner toward the toner discharge port when the toner container is rotated around the rotation axis;

an X-ray intensity ratio of titanium to silicon (Ti/Si) determined via X-ray fluorescence spectrometry of the toner is 1.0 to 3.0;

a conveyance index of the toner is 2.0 to 10.0 mg/sec; and 5 to 50% of toner particles have a ratio of (a $2^{nd}$ short axis):(a $1^{st}$ short axis) being 1.1:1 to 1.6:1, provided that:

1) a maximum length of a line segment between points A1 and A2 is designated as a long axis of a toner particle when a closed curve to form a contour of a projection plane of at least one of the toner particles is held between two parallel lines so as to make contact with points A1 and A2;

2) a line segment between points B1 and B2 is designated as the $1^{st}$ short axis of the toner particle when a midpoint of the line segment between points A1 and A2 is represented by point B, and points at the intersections of a perpendicular bisector of the line segment between points A1 and A2 passing through point B with the closed curve are represented by points B1 and B2, respectively; and 3) a longer length of either a line segment between points C11 and C12 or a line segment between points C21 and C22 is designated as the $2^{nd}$ short axis of the toner particle when a midpoint of a line segment between points A1 and B is represented by point C1, and points at the intersections of a perpendicular bisector of the line segment between points A1 and B passing through point C1 with the closed curve are represented by points C11 and C12, respectively, and also a midpoint of a line segment between points A2 and B is represented by point C2, and points at the intersections of a perpendicular bisector of the line segment between points A2 and B passing through point C2 with the closed curve are represented by points C21 and C22, respectively.

2. The toner bottle of claim 1, wherein a glass transition temperature Tg of the toner is 16 to 60° C.

3. The toner bottle of claim 1, wherein the toner comprises silica particles and titanium oxide particles as the external additive.

4. The toner bottle of claim 3, wherein a number average primary particle diameter of the silica particles is 5 to 2000 nm; and a number average primary particle diameter of the titanium oxide particles is 5 to 2000 nm.

5. The toner bottle of claim 3, wherein a number average primary particle diameter of the silica particles is 5 to 200 nm; and a number average primary particle diameter of the titanium oxide particles is 5 to 200 nm.

6. The toner bottle of claim 3, wherein a specific surface area of the silica particles determined by a BET method is 20 to 500 $m^2/g$; and a specific surface area of the titanium oxide particles determined by the BET method is 20 to 500 $m^2/g$.

7. The toner bottle of claim 3, wherein the silica particles and the titanium oxide particles are subjected to surface treatment so as to increase hydrophobic properties of the particles.

8. The toner bottle of claim 1, wherein the toner comprises composite metal oxide particles comprising silica and titanium oxide as the external additive.

9. The toner bottle of claim 8, wherein a number average primary particle diameter of the composite metal oxide particles is 35 to 500 nm.

10. The toner bottle of claim 8, wherein a number average primary particle diameter of the composite metal oxide particles is 40 to 300 nm.

11. The toner bottle of claim 1, wherein the protrusion of the toner container has a longitudinal direction and an angle between the longitudinal direction and a line parallel to the rotation axis is 20-80 degree on an unrolled plane of a side wall when the cylindrical toner container is unrolled.

12. The toner bottle of claim 1, wherein the protrusion of the toner container has a longitudinal direction and the protrusion is curved along the longitudinal direction on an unrolled plane of a side wall when the cylindrical toner container is unrolled.

13. A toner bottle comprising a cylindrical toner container for storing therein a toner comprising at least a resin, a colorant and an external additive, the toner container having a toner discharge port on an end thereof and a rotation axis along the cylindrical toner container, and the toner container being installable in an image forming apparatus, wherein the toner container has plural protrusions which are intermittently provided in an interior of the cylindrical container, the protrusions having a function to convey the toner toward the toner discharge port when the toner container is rotated around the rotation axis;

an X-ray intensity ratio of titanium to silicon (Ti/Si) determined via X-ray fluorescence spectrometry of the toner is 1.0 to 3.0;

a conveyance index of the toner is 2.0 to 10.0 mg/sec.; and 5 to 50% of toner particles have a ratio of (a $2^{nd}$ short axis):(a $1^{st}$ short axis) being 1.1:1 to 1.6:1, provided that:

1) a maximum length of a line segment between points A1 and A2 is designated as a long axis of a toner particle when a closed curve to form a contour of a projection plane of at least one of the toner particles is held between two parallel lines so as to make contact with points A1 and A2;

2) a line segment between points B1 and B2 is designated as the $1^{st}$ short axis of the toner particle when a midpoint of the line segment between points A1 and A2 is represented by point B, and points at the intersections of a perpendicular bisector of the line segment between points A1 and A2 passing through point B with the closed curve are represented by points B1 and B2, respectively; and 3) a longer length of either a line segment between points C11 and C12 or a line segment between points C21 and C22 is designated as the $2^{nd}$ short axis of the toner particle when a midpoint of a line segment between points A1 and B is represented by point C1, and points at the intersections of a perpendicular bisector of the line segment between points A1 and B passing through point C1 with the closed curve are represented by points C11 and C12, respectively, and also a midpoint of a line segment between points A2 and B is represented by point C2, and points at the intersections of a perpendicular bisector of the line segment between points A2 and B passing through point C2 with the closed curve are represented by points C21 and C22, respectively.

* * * * *